United States Patent [19]

Snow

[11] 4,364,117

[45] Dec. 14, 1982

[54] SHOCK-HARDENED, HIGH PRESSURE CERAMIC SONAR TRANSDUCER

[75] Inventor: Gordon L. Snow, Salt Lake City, Utah

[73] Assignee: Edo Western Corporation, Salt Lake City, Utah

[21] Appl. No.: 140,156

[22] Filed: Apr. 14, 1980

[51] Int. Cl.[3] ..... H04R 17/00

[52] U.S. Cl. ..... 367/152; 367/155; 367/166; 367/167; 367/162; 367/171

[58] Field of Search ..... 367/152, 153, 155, 157, 367/158, 165, 166, 167, 171, 172, 173, 162, 163, 174, 176; 310/337

[56] References Cited

U.S. PATENT DOCUMENTS

| | | | |
|---|---|---|---|
| 1,994,495 | 3/1935 | Williams | 367/171 |
| 2,473,971 | 6/1949 | Ross | 367/155 |
| 3,068,446 | 12/1962 | Ehrlich et al. | 367/158 |
| 3,277,434 | 10/1966 | Buchanan | 367/172 |
| 3,525,071 | 8/1970 | Massa, Jr. | 367/157 |
| 3,539,980 | 11/1970 | Massa, Jr. | 367/158 |
| 3,846,744 | 11/1974 | Renna, Jr. et al. | 367/165 |
| 3,952,216 | 4/1976 | Madison et al. | 367/155 |
| 4,004,266 | 1/1977 | Cook et al. | 367/155 |
| 4,300,219 | 11/1981 | Joyal | 367/174 |

*Primary Examiner*—Harold J. Tudor
*Attorney, Agent, or Firm*—Thorpe, North & Western

[57] ABSTRACT

A sonar transducer especially adapted for use when subjected to high hydrostatic pressures and extreme mechanical and explosive shock. The sonar transducer includes a conventional casing, ruggedized to withstand high pressures and a hostile environment. The casing is closed on all sides but one. An array of piezoelectric ceramic stacks are suspended inside of the casing and sandwiched between a single front mass and individual rear masses. The single front mass is positioned closest to the open side of the casing. A flexible cover is sealed over the open side of the casing and pressurized oil is placed inside the housing. Appropriate channels are provided to enable the oil to freely flow throughout the interior of the unit, including flowing inside of and about the ceramic stacks. Electrical connections are made with the ceramic stacks to allow external voltages to electrically stress the stacks, and also to allow external sensing of the voltages generated when the stacks are mechanically stressed. Appropriate lining material and filler material, as well as baffle plates, are selectively placed within the housing in order to impart a desired directivity pattern to the sound energy associated with the transducer's performance.

18 Claims, 6 Drawing Figures

SHOCK-HARDENED, HIGH PRESSURE CERAMIC SONAR TRANSDUCER

BACKGROUND OF THE INVENTION

This invention relates to sonar transducers; and more particularly to a conical beam shock-hardened, high pressure, ceramic sonar transducer for use in hostile environments.

Sonar is a term that generally refers to a system that uses underwater sound, at sonic or ultra-sonic frequencies, to detect and locate objects in the sea, or for communication. A sonar transducer is a device used underwater to convert electrical energy to sound energy, as when underwater sound is being generated and transmitted by the transducer, or for converting sound energy to electrical energy, as when the transducer is being used to intercept and amplify underwater sound signals.

At the heart of every sonar transducer is some form of piezoelectric element that undergoes a dimensional change when stressed electrically by an external voltage or that generates an electrical change when stressed mechanically by an external force. A popular, and relatively common, type of piezoelectric element is the piezoelectric ceramic. The piezoelectric ceramic may take a wide variety of forms, ranging from cylinders, discs, bars, or spheres. These ceramics may be configured to be sensitive to mechanical stress, or to undergo dimensional change only in a selected axis. For example, a conical beam sonar transducer—that is, a transducer designed to transmit and receive underwater sound energy only in one direction—will advantageously have the sensitive axis of the piezoelectic ceramic positioned so as to be aligned with the desired directivity of the transducer. Amplification may be achieved by connecting several such transducers in parallel, each having its sensitive axis in parallel with the desired direction of directivity. When the transducer is to generate, or transmit, a signal in the desired direction, the piezoelectric elements are jointly stressed by an appropriate voltage. This voltage causes each element to undergo a dimensional change along its sensitive axis, which dimensional change is in turn, coupled through a suitable transfer medium to the water immediately in front of the transducer. The dimensional change therefore causes the water to alternately be subjected to compression and tension forces. Such forces cause a positive or negative pressure wave (sound) to travel through the water, originating at the sonar transducer and traveling out therefrom according to well known principles of wave propogation theory.

In a similar fashion, albeit reversed, when a sound wave is traveling through the water in the direction of the sensitive axis of the transducer, and the sound wave strikes the transducer, a positive or negative pressure is coupled through the transducer to the piezoelectric ceramics. This pressure causes the ceramics to undergo a mechanical stress, which stress generates an electrical charge that can be sensed through appropriate electrical means.

Unfortunately, piezoelectric ceramic elements tend to be very fragile, and are easily broken or shattered when subjected to extreme pressures or explosive or severe mechanical shocks. Such pressures and shocks may be readily encountered by a sonar transducer mounted on a submarine, or other submersible, employed in war-time service. Prior attempts to protect the ceramic elements from such high pressures and explosive mechanical shocks have resulted in serious inefficiencies in the operation of the transducer. For example, prior art ruggedizing techniques used in connection with conical beam transducers have either reduced the sensitivity and/or adversely affected the directivity pattern associated with the transducers.

A further problem associated with piezoelectric ceramic elements of the type commonly used in sonar transducers is their susceptibility to damage when operated in shallow depths at higher than cavitation levels. Cavitation, as used herein, refers to the tendency of the water to literally break apart when subjected to a tension force of sufficient strength. At shallow levels, where the hydrostatic pressure levels are relatively low, the tension force sufficient to pull the water apart may be generated by the sonar transducer. If this occurs, there is a tremendous mismatch between the sonar transducer and the cavitated water, resulting in a tremendous amount of energy that remains trapped inside of the transducer. This energy may cause serious damage to occur to the ceramic element.

A further problem of any new replacement transducer adapted for operation in hostile environments is that it be interchangeable and compatible with existing sonar transducers. This is because sonar transducers, of the type discussed herein, are typically used with expensive submarines or other large and complex submersibles that have long been designed to be used only with a transducer having a prescribed configuration, both mechanically and electrically. Thus, any ruggedized replacement transducer must be compatible with existing mounting structure, as well as existing and control circuitry, if the transducer is to be a viable replacement.

SUMMARY OF THE INVENTION

A principal object of the present invention is to provide a shock-hardened, high pressure, ceramic sonar transducer that can be used at high hydrostatic pressures and in hostile environments.

A further object of the present invention is to provide such a transducer that efficiently functions as a conical beam transducer having a desirable directivity pattern.

Another object of the invention is to provide a shock-hardened, high pressure, conical beam transducer that is compatible and interchangeable with existing transducer models used on submarines and other large and complex submersibles.

An additional object of the present invention is to provide a shock-hardened, high pressure, conical beam transducer that can withstand the severe mechanical and explosive shocks that may be incurred in war-time service.

Still a further object of the invention is to provide a shock-hardened, high pressure, conical beam transducer that is pressure compensated so that the high ambient hydrostatic pressure levels experienced on the ocean floor do not affect the performance characteristics of the transducer.

Still another object of the present invention is to provide such a transducer that is internally compensated to prevent damage to the transducer elements if the transducer is operated in shallow depths at higher than cavitation levels.

The above and other objects of the invention are realized in an illustrative embodiment that includes piezoelectric ceramic elements advantageously mounted in a ruggedized housing having an open front. The housing is made from a material capable of withstanding the high hydrostatic pressures and severe mechanical shocks that may occur at deep underwater depths during war-time service. The ceramic elements are mounted inside of the housing so that their vibrational axis faces the open front. Several ceramic elements are used within the transducer. Advantageously, several elements are fastened together in series to form a transducer stack; and several transducer stacks are then connected in parallel one to the other. A single large front mass is coupled to the front end of each of the ceramic stacks. Similarly, a large rear mass is attached to the rear of each of the ceramic stacks. The size and weight of the front and rear masses are carefully chosen so as to reduce the resonant frequency of the ceramic stacks to a desired frequency.

The ceramic stacks, including the rear masses and front mass are subspended within the housing so that the plane formed by the signal front mass faces the open front of the housing. Thus, when the transducer is transmitting a sound wave (as when an alternating electrical voltage at a desired frequency has been used to cause a vibrational dimensional change in the ceramic elements), the front mass vibrates back and forth (moving the plane of the front mass alternately closer to and farther away from the open front) and an impulse is imparted to the fluid in front of the transducer. Similarly, an external sound wave striking the transducer will impart a mechanical force to the front mass, which in turn couples a mechanical stress to the ceramic elements, thereby causing the ceramic elements to generate an electric charge that can be sensed through appropriate electrical means.

The open front of the housing is sealed over with a flexible cover or boot so as to prevent the water from actually entering inside of the housing. However, because of the flexible nature of the covering, pressure waves can easily pass therethrough in either direction. Once the transducer is sealed with the flexible boot, the transducer is also filled with oil to equalize the effects of the extreme hydrostatic pressures encountered at high operating depths. Channels are provided within the housing and the elements located therein to enable the oil to freely flow in and around the ceramic elements.

The inside walls of the transducer housing are lined with a special material adapted to create an impedance mismatch for the sound energy. That is, the special material impedes the passage of sound energy through the walls of the housing. The mismatch created by these special materials thus causes the majority of the sound energy to pass through the flexible covering or boot sealed over the open front of the housing. Thus, the transducer acquires a desired directivity pattern.

The transducer further includes, in the end opposite the sealed over front, additional lining material and a network of baffle boards to prevent or impede the transfer of sound energy through the back end of the transducer.

In one embodiment of the invention, wherein the optimum frequency of operation for the transducer is selected to be around 12 kHz, the lining substance used within the transducer includes a two-layered substance, a first layer being a material having the consistency of cork and rubber, and a second layer being a polymer. The polymer serves not only to keep the oil away from the cork and rubber substance, but also serves to enhance the mismatch designed to exist at the walls of the housing in order to impart the desired directivity pattern to the sound energy. The polymer substance also serves, in the back portion of the housing, to hold the baffle boards in a desired position.

The transducer further includes a potted transformer that serves to electrically interface between the ceramic stacks and a connector mounted through the wall of the housing. The connector is compatible with the cables that are traditionally used to interface with conventional sonar transducers. Furthermore, the electrical impedance characteristics of the transformer and ceramic stacks are designed to allow the unit to be monitored and controlled by convential sonar circuitry. The housing of the transducer is further configured in a shape that makes it fully mechanically interchangeable with conventionally used transducers.

BRIEF DESCRIPTION OF THE DRAWINGS

The above and other objects, features, and advantages of the invention will be more apparent from the following more particular description presented in connection with the accompanying drawings, in which.

DESCRIPTION OF THE PREFERRED EMBODIMENT

Figure 1:
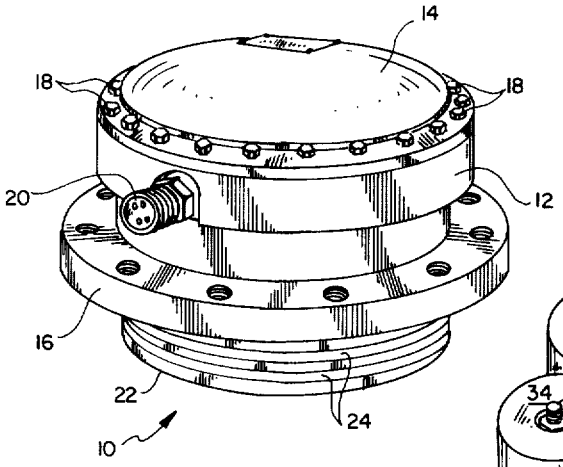
FIG. 1 is a perspective view of the exterior of a sonar transducer made in accordance with the principles of the present invention.

Referring first to FIG. 1, there is shown generally at 10 an exterior view of a shock-hardened, high pressure sonar transducer made in accordance with the principles of the present invention. The housing 12, typically in a circular shape, includes an end plate 14 and a mounting flange 16. As seen in the figure, the end plate 14 is securely bolted to the housing 12 with bolts 18. An electrical connector 20 provides the electrical interface between the interior of the transducer 10 and an external monitoring point. The entire configuration of the transducer may advantageously be designed to be fully interchangeable with existing sonar transducers, such as the standard UQN Transducers (AT-200 types).

A flexible rubber covering or boot 22 is placed over the front end of the housing 12. A pair of stainless steel straps 24 helps to securely hold the rubber boot 22 in place over the front end of the housing.

Figure 2:
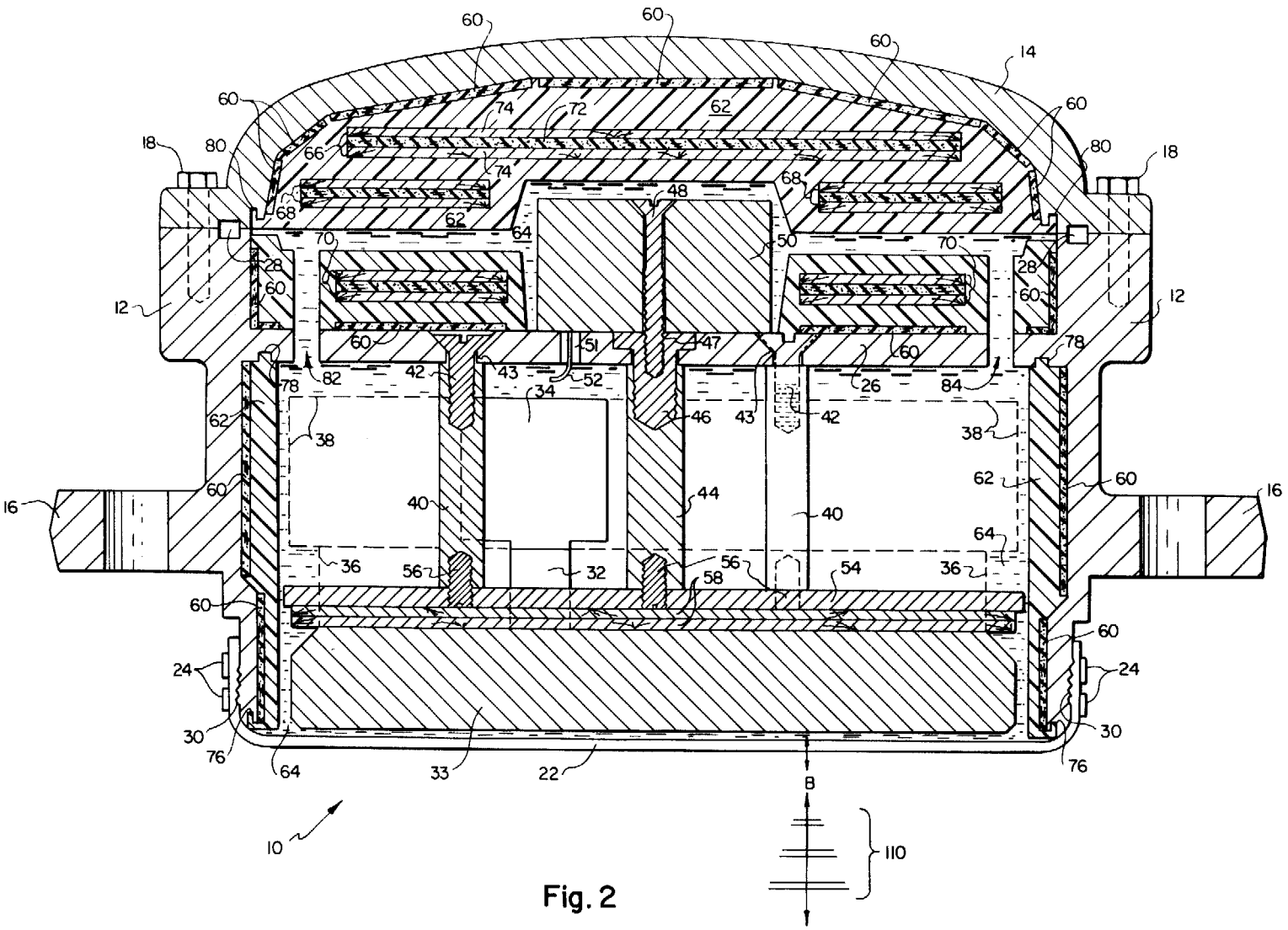
FIG. 2 is a side sectional view of the sonar transducer of FIG. 1, with all but one of the ceramic stacks removed therefrom.

Referring now to FIG. 2, there is shown a cross sectional view of the transducer 10 of FIG. 1 The housing 12 is essentially a cylindrical element from which the mounting flange 16 extends. An interior wall 26, integral with the housing 12, divides the housing into lower and upper chambers. The wall 26 also serves to help mount the ceramic stack 32 within the transducer. The end plate 14 is dome shaped and is bolted securely to the housing 12 with bolts 18. A gasket 28 is used around the entire circumference of the interface between the end housing 12. Similarly, sound energy originating outside of the transducer 10 has a difficult time passing through the walls of the housing 12 and through the lining material 60 into the inside portion of the transducer.

The material best suited for the lining material 60 for a transducer designed to optimally operate at around 12 kHz, has been determined by the inventor to be a substance having properties similar to that of both cork and rubber. Such a substance is commercially available under the tradename Corprene, manufactured by the Armstrong Company. As shown in FIG. 2, the Corprene 60 is attached to the inner walls of the housing 12 at almost every available location. It is also attached to the inside walls of the upper chamber, including the inside of the dome-shaped end plate 14. A suitable material for bonding the Corprene 60 to the inside walls of the housing 12 and end plate 14 is a commercially available two-part epoxy called Eccobond, manufactured by Emerson & Cuming, Inc. of Kenton, Mass.

To enhance the mismatch characteristics appearing along the inner walls of the transducer housing, and to preserve the desired impedance mismatch over a wide range of pressures, a second lining material 62 is employed. This second lining material 62, which is typically a polymer, also serves to protect the first lining material 60, or Corprene, from being exposed to the oil 64 that fills all the vacant space within the transducer (to be discussed below). In the upper chamber or portion of the transducer housing, immediately below the end plate 14 and above the inner wall 26, the polymer material 62 also serves to position some baffle boards 66, 68, and 70, in a desired spaced-apart relationship. Each baffle board is made up of two components. Referring to baffle board 66, for example, center material 72 having a desired sound or acoustical impedance is sandwiched between layers of fiberboard 74. In the preferred embodiment of the invention, the center material 72 is also Corprene, the same substance used as the first lining material 60, however any suitable substance having the desired sound impedance characteristics could be used. The fiberboard layers 74 may advantageously be made from Masonite.

A suitable polymer to serve as the second lining material 62 has been determined to be polyurethyane. The polyurethyane is first mixed in liquid form and then poured into the insides of the housing 12 and end plate 14. Suitable potting molds are used to confine the polyurethyane, in its liquid state, within desired areas. After the polyurethyane cures, then the potting molds are removed and the polyurethyane lining is in place. Small ridges, or grooves, such as those shown at 76, 78 and 80, are machined or otherwise inserted into walls of the housing 12 and end plate 14 to give the polyurethyane 62 (or other polymer) a suitable toe-hold into which it can flow and, when cured, hold itself in place.

Once assembled, the unit is filled with evacuated oil 64 through a suitable oil fill plug (not shown). The evacuated oil 64 is inserted into the unit under pressure, causing the flexible covering or boot 22 to bulge out somewhat at nominal, above-water, pressures. This is done to compensate for the high hydrostatic pressures that are encountered at high underwater depths. The oil 64 is free to flow throughout the interior of the entire transducer. Note that suitable passageways 82 and 84 allow the oil 64 to also pass into the upper chamber of the transducer. Thus, the oil 64 advantageously serves as a medium through which the pressure is equalized throughout the interior of the entire transducer. This can be extremely important at high operating depths where extreme hydrostatic pressures are encountered. In the preferred embodiment, the oil 64 is a special type of caster oil which has been dehydrated. Dehydration of the oil is important so that the oil is non-conductive. If the oil were conductive, then it could short out the ceramic elements 32 and cause the transducer to malfunction.

Figure 3:
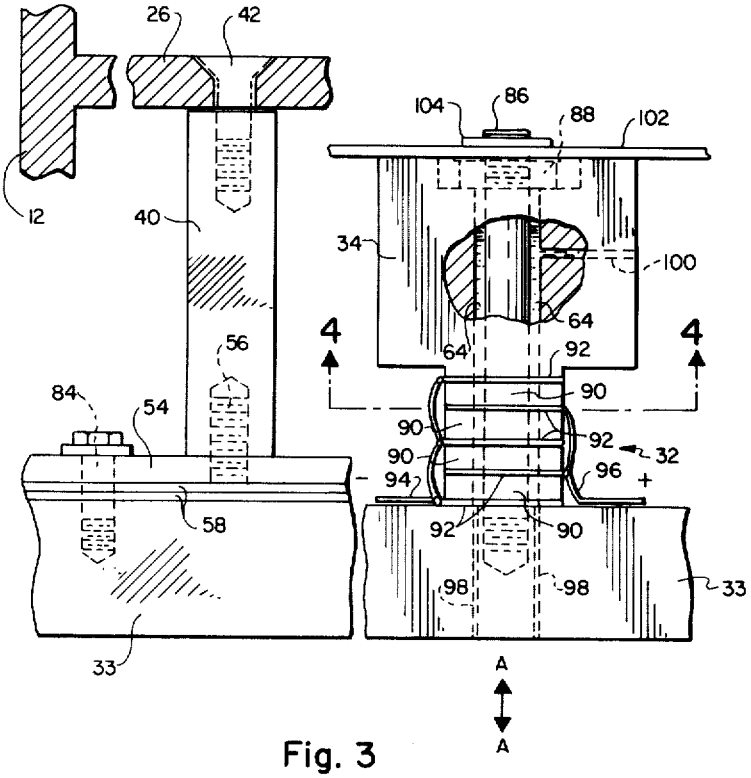
FIG. 3 is a side view of a single ceramic stack, including front and rear masses and support means.

Referring now to FIG. 3, there is shown a fragmented view detailing the ceramic stack 32 and the method by which it is suspended within the transducer housing 12. As discussed in connection with FIG. 2, a rod 40 is bolted to the inner wall 26 of the housing 12. A lower end of the rod 40 is similarly bolted to the holding plate 54. The fiberboards 58 and the front mass 33 are secured to the holding plate 54 with a bolt 84. This bolt 84 passes through holes in the holding plate 54 and the fiberboards 58 and screws into a threaded hole drilled in the front mass 33. Hence, the fiberboards 58 are literally sandwiched between the holding plate 54 and the front mass 33.

The ceramic stack 32 is similarly sandwiched between the rear mass 34 and the front mass 33. That is, a bias bolt 86 passes through a hole in the center of the rear mass 34, through similarly centrally located holes through the ceramic stacks 32, and is securely threaded into the front mass 33. Note that the ceramic stack 32 includes a stack of four ceramic rings 90. Each ring 90 is a piezoelectric ceramic thin-walled piece adapted to vibrate in the thickness mode. Thus, the sensitive vibrational axis of the ceramic stack 32 is in the direction of the arrow indicated by the letters A—A.

Sandwiched between each ceramic ring 90, as well as between the ring 90 and the rear mass 34 and the ring 90 and the front mass 33, is a conductive spacer 92. The conductive spacer 92 serves two functions: (1) it allows electrical contact to be made with each side of the ceramic rings 90, and (2) it maintains the bonding agent used to glue the rings 90 to each other, as well as to the front and rear masses, at a desired thickness. A wire 94, designated as the negative or "−" in FIG. 3, is connected to the conductive spacers 92 at the extreme top and bottom of the ceramic stack 32 as well as to the spacer in the middle thereof. Similarly, another wire 96, designated as the positive or "+" wire in FIG. 3, is connected to the remaining two conductive spacers. These two wires 94 and 96 form part of the cable 52 referred to in FIG. 2 that is connected to the transformer 50. Other ceramic stacks have similar positive and negative wires that are connected in parallel with the wires 94 and 96.

The bias bolt 86, as its name implies, imparts a bias force on the ceramic stack 32. That is, a nut 88 is tightened sufficiently to place the ceramic rings 90 in compression, thereby preventing them from ever entering a tension mode where they are more susceptible to damage (as might exist, for example, when the transducer is operated in shallow depths at higher than cavitation levels). With the ceramic stack 32 under constant compression, it is more apparent why the conductive spacers 92 are needed to hold the bonding agent (that glues the ceramic rings 90 to each other) in place. Otherwise, the bonding agent would be forced out from between the ceramic rings 90 by the compression force.

It is necessary to bond the ceramic rings 90 to each other as well as to the front and rear masses so as to prevent lateral movement between these elements. That is, the bias bolt 86 has a smaller diameter than the hole plate 14 and the housing 12 so as to insure the integrity of the seal. Both the end plate 14 and the housing 12, including the wall 26 and the flange 16, are typically made from steel, and the structure formed therefrom is capable of withstanding the extreme severe shocks and pressures that might be encountered at high operating depths during war-time or other hostile periods.

The exterior edge 30 of the housing 12 towards the front end of the transducer 10 is grooved, threaded, or otherwise serrated so as to provide a suitable surface with which the flexible covering or boot 22 may interface to provide a tight seal. In addition to the steel bands 24 previously mentioned (which bands securely hold the flexible boot 22 in place over the front end of the housing 12), a bonding agent is used to securely bond the ends of the flexible covering 22 to the exterior edges 30 of the housing 12. Typically, the flexible covering or boot 22 is made from a special grade of neoprene from which all free sulfur has been removed. The neoprene boot 22 is typically ⅝ inches thick across the front portion of the transducer 10, and narrows to about ⅜ inches thick along the edges that are bonded to the walls 30. It is important that there be no sulfur contained in the flexible covering 22 because sulfur is a contaminating agent that can cause problems for the ceramic elements and deteriorate silver electrodes and other sensitive parts within the transducer. A suitable bonding agent to bond the boot 22 to the walls 30 is PRC 1538, manufactured by Products Research Corporation.

A key element of a transducer 10 is the piezoelectric ceramic stack 32. For purposes of clarity, only one such stack is shown in FIG. 2, although, as will be more apparent from the description which follows, several such stacks are used within the transducer. The details of the ceramic stack 32 will be discussed in connection with FIG. 3. A front mass 33 is attached to a front end of the ceramic stack 32. Similarly, a rear mass 34 is attached to the rear of the ceramic stack 32. The front mass 33 is a single integral mass that connects to all the ceramic stacks 32 that may be used within the transducer. The rear mass 34, on the other hand, attaches only to a single ceramic stack 32. The additional ceramic stacks (not shown in FIG. 2) and their corresponding rear masses generally occupy the areas bounded by the dotted lines 36 and 38 respectively.

Suspension rods 40, typically made from mild steel, are used to suspend the ceramic stacks 32, including their corresponding rear masses 34, and the front mass 33, to the interior wall 26 of the housing 12. The upper end of the rods 40 has a threaded hole therein into which an appropriately sized bolt 42 may be inserted. The bolt 42 ideally has a flanged head and is inserted into the rod 40 through a hole 43 in the wall 26 that has been machined so that the head of the bolt 42 may be countersunk therein.

A center rod 44, also typically made from mild steel, performs the same function as the suspension rods 40. However, a bolt 46 used to tie the upper end of the rod 44 to the wall 26 may be somewhat different than the bolts 42. In the preferred embodiment, the bolt 46, which is countersunk into the wall 26, has an additional hole 47 threaded in the center thereof into which another bolt 48 may be screwed. The bolt 48 is used to securely fasten a potted transformer 50 to the upper side of the wall 26 in the upper chamber of the housing 12. A cable 52 exits from the transformer 50 and passes through a hole 51 in the wall 26 into the lower portion of the transducer 10. This cable 52 eventually connects to all of the ceramic stacks 32, as will be more apparent from the description which follows. Another cable (not shown) connects the transformer 50 to the connector 20 (FIG. 1). The cable 52, as well as the connecting cable between the transformer and a connector may either be detachably connected to terminals located on the transformer 50 or they may be permanently connected to the appropriate windings inside of the transformer 50.

The lower end of the suspension rods 40 and 44 connect to a holding plate 54. Typically, the holding plate is also made from mild steel. Threaded studs 56 serve to tie the rods 40 and 44 to the plate 54. On the underneath side of the holding plate 54, sandwiched between the front mass 32 and the plate 54, are two layers of tempered fiberboard 58. A suitable material for this fiberboard is Masonite. This fiberboard 58 serves as a release mechanism to reduce vibrations from being coupled from the front mass 33 through the rods 40 and 44 to the wall 26 of the housing 12. The manner of connecting the fiberboard 58 and front mass 33 to the holding plate 54 will be discussed in connection with FIG. 3. It is significant to note that both the holding plate 54 and the fiberboard 58 have holes therein so that the ceramic stack 32 is sandwiched directly between a rear mass 34 and the front mass 33. In other words, the ceramic stack 32 has no direct contact with either the holding plate 54 or the fiberboard 58.

The inside walls of the housing 12 are lined with a special lining material 60 adapted to impede any sound energy from passing therethrough. The mechanism used to achieve this result is to select the lining material 60 so that a significant mismatch is created at the interface of the material 60 and the housing 12. As used here, "mismatch" refers to the relative ease (or difficulty) with which sound energy may pass from one medium to another. It is common to refer to this "mismatch" in terms of acoustic impedance (sometimes referred to as density X velocity). The acoustic impedance "mismatch" is analogous to transmission-line theory terminology in that a good match (equal impedances) allows the best (maximum) power transfer. A poor match reflects the energy and results in poor (minimum) power transfer, or a low transmittal of energy. For the invention herein described, the front end of the transducer 10 over which the flexible cover or boot 22 is placed appears as an acoustic window that provides a good impedance match, thereby allowing good acoustical transmission qualities along the desired axis (that is, through the acoustic window or flexible boot 22). Conversely, the acoustic mismatch between the lining material 60 and the steel housing 12 is great, thereby providing the desired poor acoustical transmission qualities in this area.

Figure 4:
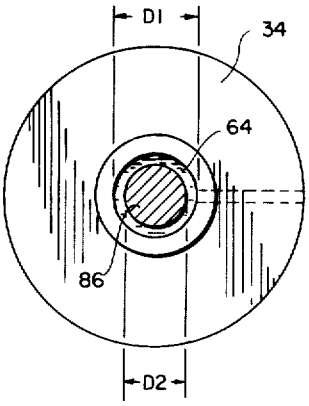
FIG. 4 is a sectional view taken along the line 4—4 of FIG. 3.

To efficiently transfer sound energy from one medium to another, the impedances of both materials need to be matched, either directly, or through a suitable impedance transfer network. When a mismatch exists between the impedances of two materials or substances, reflections of the sound energy result, causing a less efficient transfer of the energy from one medium to the other. Thus, referring to the sonar transducer 10, the lining material 60 is selected so as to have a sound or acoustical impedance that is significantly different from that of the housing 12 with respect to underwater sound energy at a desired frequency. When such a mismatch of impedances is present, sound energy originating within the transducer has a difficult time passing through both the lining material 60 and the walls of the through the rear mass 34 or through the ceramic rings 90. This difference in diameter is perhaps best illustrated in the sectional view of FIG. 4. Typical dimensions for D1, the inside diameter of the hole through the rear mass 34 and ceramic rings 90, might be 0.55 inches. A typical dimension for D2, the diameter of the bias bolt 86, might be 0.25 inches. Thus, were it not for the bonding together of the various elements, it would be possible for the ceramic rings 90 to undergo lateral movement with respect to one another. A suitable bonding agent that may be used to bond the elements of the ceramic stack 32 is Epon-VI, manufactured by Hy-Sol, Inc.

The space inside of the ceramic rings 90 created by the difference between diameters D1 and D2 is advantageously filled with some of the oil 64. The oil 64 is allowed inside of the ceramic rings 90 and rear mass 34 through small channels 98, passing through the front mass 33, and another small channel 100, passing laterally through the rear mass 34. These channels are typically 0.1 inches in diameter and freely allow the oil to pass in and through the center portion of the ceramic stack 32. Thus, the pressure on both the inside and outside of the ceramic rings 90 may be maintained at approximately the same value, thereby preventing damage to the somewhat fragile ceramic rings when exposed to sudden changes in pressure (such as explosive shocks).

A conductive plate 102, typically made of aluminum, may advantageously be secured to the top of the rear masses 34 by a nut 104 that is threaded on the bias bolt 86. This plate 102 would extend to all of the rear masses 34 that are employed within the transducer. The plate is then electrically grounded through a separate wire (not shown in the drawings) in order to maintain the rear masses 34, as well as the entire housing unit 12 and 14, at a known reference potential.

Figure 5:
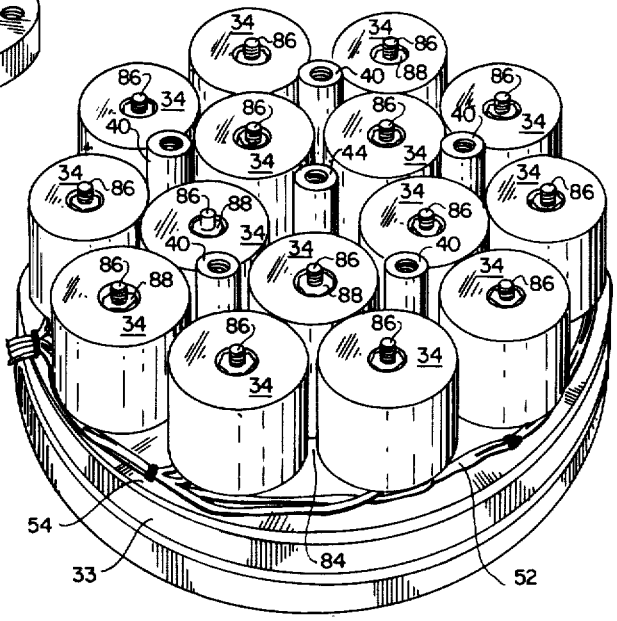
FIG. 5 is a perspective view of an array of piezoelectric ceramic stacks including a single front mass and individual rear masses, that is used within the transducer of FIGS. 1 and 2.

Referring now to FIG. 5, a perspective view is shown of the ceramic stacks, including rear masses 34 and single front mass 33, that are suspended within the front portion of the housing 12. For the sake of clarity, the back plate 102 (shown in FIG. 3) that normally attaches to the top portion of the rear masses 34 is not shown. As FIG. 5 illustrates, there are in the preferred embodiment fifteen ceramic stacks 32 (including rear masses 34) that are utilized as part of the transducer 10. The bias bolts 86, as well as the corresponding nuts 88 are readily visible in the figure. Also visible in FIG. 5 are the suspension rods 40, including the center rod 44. Note that five suspension rods 40 plus the center rod 44 are used in suspending the fifteen ceramic stacks 32. The holding plate 54, as well as the front mass 33 and the cable assembly 52 are also visible in the perspective view of FIG. 5. Not visible in FIG. 5, because of their smaller diameter, are the fiberboards 58 (see FIG. 2) that are sandwiched between the holding plate 56 and the front mass 33.

In operation, the ceramic stacks 32 are sensitive to mechanical forces along the A—A axis (FIG. 3). For example, in FIG. 2, a sound wave 110 (a series of tension and compression forces in the water) may be directed towards the acoustical window front face, or flexible boot 22, of the transducer 10. The energy associated with the wave front 110 is coupled through the flexible boot 22 to the oil 64 and/or the front mass 33. These forces are, in turn, sensed at the ceramic stack 32, where they are converted (through the piezoelectric effect) to an electric charge. Because of the vibrational nature of the mechanical stresses that are present, the charges developed at the ceramic stack 32 are also vibrational or alternating in nature. Accordingly, they are sensed through the cable 52 at the transformer 50 as an alternating or changing voltage, which changing voltage is sensed at the output of the transformer as a detectable signal. Such a signal is thus an indication that a sound wave has been detected by the transducer. This signal may typically have a short duration, as when a short burst of sound energy is received.

Correspondingly, when the sonar transducer is to be used to transmit or generate a sound wave, an appropriate alternating voltage signal is directed to the transformer 50 where it is transformed to appropriate levels and then coupled to the ceramic stacks 32 via the cable 52. When stressed electrically, the ceramic stacks 32 vibrate longitudinally, thereby causing the front mass 33 to vibrate with a back and forth motion. Although this motion is very small, typically only on the order of angstroms, it nonetheless imparts a wave front of sound energy through the oil 64 and/or the acoustical window or flexible boot 22 to the water that is in front of the transducer. The wave front 110 thus generated radiates out from the flexible boot 22 according to well known principles of acoustical underwater wave theory.

Figure 6:
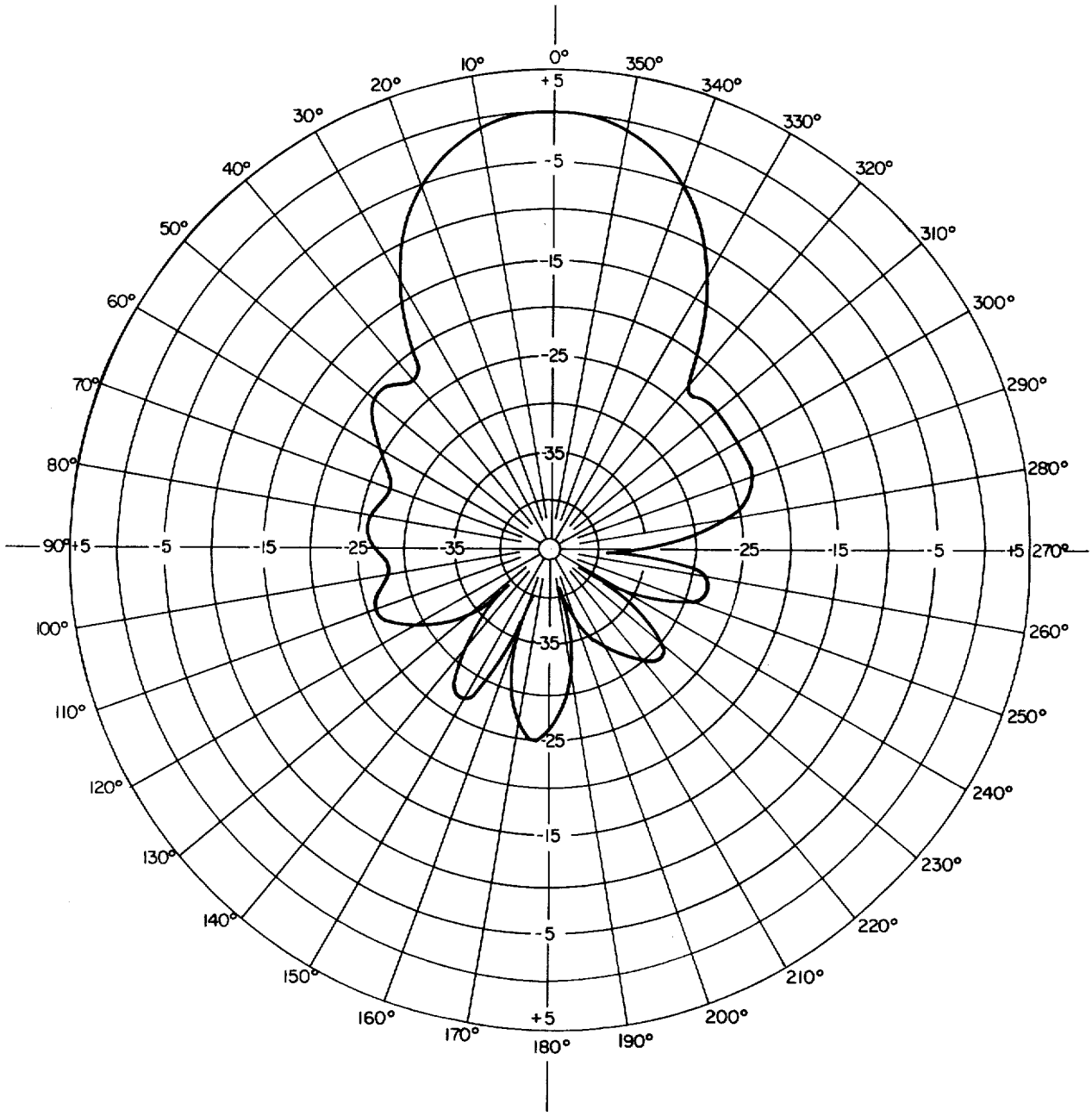
FIG. 6 shows a representative directivity pattern obtained from the sonar transducer of FIGS. 1 and 2.

The Corprene 60 and the polyurethyane 62 (or equivalent substances) advantageously define an acoustical impedance mismatch through which sound energy may not efficiently pass. Accordingly, only small amounts of sound energy pass through the sides of the housing 12 or through the back end plate 14. A representative directivity pattern that is achieved with a transducer built in accordance with the manner herein disclosed is illustrated in FIG. 6. As FIG. 6 illustrates, the main portion of the sound or acoustical energy is always directed or received within $\pm 30°$ from the front alignment of the transducer. Side lobes and back lobes of the sonar energy are more than 20 dB below those directed out through the front acoustical window or boot 22 of the transducer. The directivity pattern shown in FIG. 6 was measured at 12 kHz using a sonar transducer built according to the manner taught herein. Measurements were taken only after subjecting the transducer for more than eight hours to 1,000 psi pressure and high power outputs. This type of directivity pattern is highly desirable for conical beam transducers; and to realize such a directivity pattern in a ruggedized, high pressure, shock-hardened transducer has been heretofore unknown.

While the invention herein disclosed has been described by means of specific embodiments and applications thereof, numerous modifications and variations could be made thereto by those skilled in the art without departing from the scope of the present invention. It is therefore to be understood that within the scope of the appended claims, the invention may be practiced otherwise than as specifically described herein.

What is claimed is:

1. A shock-hardened high pressure sonar transducer comprising:

a housing made from a first material having an open front, said housing being capable of withstanding high pressures and severe mechanical shock without damage resulting thereto;

a flexible cover sealed over and around said open front thereby creating a sealed-over front of said housing;

a fluid disposed inside of said housing for coupling pressures throughout the inside of said housing, said fluid being inserted into said housing under pressure;

acoustic impedance mismatch means selectively placed on the inside of said housing for causing said transducer to assume a desired directivity pattern wherein substantially all of the sonar signals associated with the operation of said transducer must be received or transmitted through the sealed-over front of said housing;

protection means for shielding said acoustic impedance mismatch means from direct contact with said pressurized fluid; and transducer means mounted inside said housing for sensing and generating sonar signals, said transducer means comprising a plurality of piezoelectric stacks, each having front and rear ends, and each adapted to undergo a dimensional change when stressed electrically and to generate an electrical signal when stressed mechanically;

a single front mass attached directly to the front ends of each of said stacks;

respective rear masses attached directly to the rear ends of each of said stacks;

means for allowing said pressurized fluid to flow around and inside of said stacks;

means for making electrical contact with said stacks, said means adapted to allow external electrical signals to electrically stress said stacks and to further allow electrical signals generated by mechanical stress of said stacks to be externally sensed.

2. A sonar transducer as defined in claim 1 wherein said mounting means positions each of said stacks within said housing so that said front mass is closest to said sealed-over front of said housing and said rear mass of each stack is furthest away from said sealed-over front, and further wherein said acoustic impedance mismatch means comprises a lining material having selected acoustic properties that is affixed to selected portions of the inside of said housing, and also wherein said protection means comprises a second material impervious to said pressurized fluid that covers said lining material.

3. A sonar transducer as defined in claim 2 wherein said piezoelectric ceramic stacks are cylindrical in shape having a hole longitudinally through the center thereof, said hole facilitating the mounting of each of said stacks between said front and rear masses, and said hole further providing space inside of said stacks through which said fluid may flow.

4. A sonar transducer as defined in claim 3 further including a partition wall that divides the interior of said housing into first and second compartments, said open front of said housing opening up into said first compartment, and said lining and second materials being used in both of said compartments, and further wherein said piezoelectric stacks, front mass, and rear masses are suspended from said partition wall so as to be located within said front compartment, said partition wall having channels threthrough through which said fluid may flow between said compartments.

5. A sonar transducer as defined in claim 4 further including a plurality of laminated baffle plates selectively positioned within said second chamber, said laminated baffle plates each comprising a layer of said first material sandwiched between layers of a fiberboard material, such as Masonite.

6. A sonar transducer as defined in claim 5 wherein said housing is circular in shape, said baffle plates comprising circular discs that are selectively spaced inside of said second compartment.

7. A sonar transducer as defined in claim 3 wherein said first material includes rubber and cork, such as Corprene.

8. A sonar transducer as defined in claim 3 wherein said second material is a polymer, such as polyurethane.

9. A sonar transducer as defined in claim 2 wherein said fluid comprises a dehydrated and and non-conductive oil, such as caster oil.

10. A sonar transducer as defined in claim 2, wherein said flexible cover comprises neoprene.

11. A shock-hardened, high pressure ceramic sonar transducer comprising:

a housing having an open end;

a lining made of an acoustic impedance mismatch material affixed to at least a portion of the inside walls of said housing for causing the transducer to exhibit a desired directivity pattern wherein substantially all of the sonar signals associated with the operation of the transducer are received or transmitted through the open end of said housing;

a flange protruding inwardly around the inside wall of said housing;

a plurality of piezoelectric ceramic stacks attached to said flange with a front end of each of said stacks facing said open end of said housing, each of said stacks having electrical contact made therewith via an electrical conductor;

a front mass attached to the front ends of said ceramic stacks;

a flexible cover sealed over said open end of said housing, thereby creating a sealed-over front end of said housing;

a transformer mounted to said flange and electrically coupled to said electrical conductor;

means for making external electrical contact with said transformer through said housing;

a plurality of laminated baffle boards positioned near a rear end of said ceramic stacks, said baffle boards being comprised of material that exhibit a desired acoustic impedance;

a dehydrated, nonconductive oil disposed under pressure inside of said housing for transferring, equalizing, and distributing pressures within said transducer; and a covering material selectively placed inside of said housing to cover said lining material and shield it from contact with the oil and to hold and maintain said baffle boards in a desired position.

12. A sonar transducer as defined in claim 11 wherein said piezoelectric ceramic stacks comprise:

at least one ceramic ring, said ring adapted to undergo a dimensional change when stressed electrically and to generate an electric signal when stressed mechanically;

a rear mass attached to one end of said ring; and connection means for allowing said electrical conductor to make electrical contact with said ring.

13. A sonar transducer as defined in claim 12 wherein said lining material includes a first substance comprising cork and rubber, such as Corprene.

14. A sonar transducer as defined in claim 12 wherein said covering material is a polymer that is impervious to said oil.

15. A sonar transducer as defined in claim 13 wherein said baffle boards comprise a layer of said first substance sandwiched between layers of a second substance.

16. A sonar transducer as defined in claim 15 wherein said second substance comprises fiberboard.

17. A sonar transducer as defined in claim 16 wherein said fiberboard comprises Masonite.

18. A sonar transducer as defined in claim 11 wherein said oil comprises a dehydrated, non-conductive form of castor oil that is placed within said housing under pressure.

* * * * *